US011225398B2

(12) United States Patent
Barneman

(10) Patent No.: US 11,225,398 B2
(45) Date of Patent: Jan. 18, 2022

(54) GUIDE RAIL ALIGNMENT METHOD AND ARRANGEMENT

(71) Applicant: Kone Corporation, Helsinki (FI)

(72) Inventor: Hakan Barneman, Helsinki (FI)

(73) Assignee: Kone Corporation, Helsinki (FI)

( * ) Notice: Subject to any disclaimer, the term of this patent is extended or adjusted under 35 U.S.C. 154(b) by 524 days.

(21) Appl. No.: 16/113,557

(22) Filed: Aug. 27, 2018

(65) Prior Publication Data

US 2019/0106296 A1 Apr. 11, 2019

(30) Foreign Application Priority Data

Oct. 9, 2017 (EP) ..... 17195495

(51) Int. Cl.
*B66B 19/00* (2006.01)

(52) U.S. Cl.
CPC ..... *B66B 19/002* (2013.01); *B66B 19/00* (2013.01)

(58) Field of Classification Search
CPC ..... B66B 19/002; B66B 19/00
See application file for complete search history.

(56) References Cited

U.S. PATENT DOCUMENTS 7,559,409 B2 * 7/2009 Barneman ..... B66B 5/04 187/408
2009/0120734 A1 * 5/2009 Barneman ..... B66B 19/002 187/408
2009/0266651 A1 * 10/2009 Van Der Meijden ..... B66B 19/002 187/408
2010/0309452 A1 * 12/2010 Qiu ..... B66B 19/00 356/3
2012/0118219 A1 * 5/2012 Lindberg ..... B66B 13/12 116/201
2013/0025236 A1 * 1/2013 Erny ..... B66B 19/00 52/745.15
2014/0138189 A1 * 5/2014 van der Meijden ..... B66B 7/02 187/406

(Continued)

FOREIGN PATENT DOCUMENTS

EP 2733105 A1 5/2014
WO WO-9323323 A1 11/1993

OTHER PUBLICATIONS

Extended European Search Report for application No. EP17195495 dated Apr. 11, 2018.

*Primary Examiner* — Michael A Riegelman
(74) *Attorney, Agent, or Firm* — Harness, Dickey & Pierce, P.L.C.

(57) ABSTRACT

The current disclosure relates to a guide rail alignment method comprising attaching and aligning a first pair of elevator car guide rail sections in an elevator shaft and mounting a vertically moveable base between the guide rail sections. After the first pair of elevator car guide rail sections has been aligned, a target member comprising a target point is removably attached to a guide rail section, and a positioning light source able to produce a beam of collimated light is attached to the vertically moveable base, so that a beam of collimated light emitted in a predetermined direction by the positioning light source meets the target point of the target member. The position of the light source is then used to align a guide rail section of a second pair of guide rail sections. The current disclosure further relates to an elevator guide rail alignment arrangement.

12 Claims, 3 Drawing Sheets

(56) References Cited

U.S. PATENT DOCUMENTS

| | | | | |
|---|---|---|---|---|
| 2015/0128403 | A1* | 5/2015 | Valkama | B66B 19/002 29/464 |
| 2015/0217972 | A1* | 8/2015 | Hawkins | B66B 19/002 187/391 |
| 2016/0060078 | A1* | 3/2016 | Mertala | B66B 19/002 52/741.1 |
| 2016/0311648 | A1* | 10/2016 | Vaarala | B66B 19/00 |
| 2016/0311657 | A1* | 10/2016 | Kilpelainen | B66B 19/002 |
| 2016/0311659 | A1* | 10/2016 | Mertala | B66B 19/002 |
| 2016/0325968 | A1* | 11/2016 | Baker | B66B 13/08 |
| 2017/0038204 | A1* | 2/2017 | Kilpelainen | G01C 3/08 |
| 2017/0313553 | A1* | 11/2017 | Puntener | B66B 19/002 |
| 2019/0106296 | A1* | 4/2019 | Barneman | B66B 19/002 |
| 2021/0016996 | A1* | 1/2021 | Makinen | B66B 19/002 |
| 2021/0016997 | A1* | 1/2021 | Haag | B66B 19/002 |

* cited by examiner

GUIDE RAIL ALIGNMENT METHOD AND ARRANGEMENT

This application claims priority to European Patent Application No. EP171954951 filed on Oct. 9, 2017, the entire contents of which are incorporated herein by reference.

TECHNICAL FIELD

The present disclosure relates to installation of elevator guide rails. It especially relates to a guide rail alignment method during guide rail installation and to an arrangement for aligning guide rails.

BACKGROUND ART

Guide rails are used to guide the vertical movement of an elevator car in an elevator shaft. Usually there are two guide rails on the opposite walls of the elevator shaft and the elevator car is located between them and linked to the guide rails through guide shoes or guide rollers facing the guide rails. Guide rails are constructed from multiple guide rail sections that are connected to each other from their vertical ends to form a continuous guiding structure for the elevator. The guide rails are attached to the walls of the elevator shaft or other structures surrounding the elevator.

Guide rails are typically installed in a bottom-up manner. The two bottom-most guide rail sections of a given guide rail pair are attached in place. The straightness of the guide rail sections is checked and adjusted if necessary through alignment. Then, the next pair of guide rail sections is mounted on top of the first pair and secured in place. The adjacent guide rail sections are then connected to each other. The straightness of the guide rail sections is checked and alignment is performed if necessary. The process is repeated until all guide rails are complete.

The accurate alignment of the adjacent guide rail sections is necessary to prevent disturbances in the elevator path when it moves over a junction of two guide rail sections and to ascertain that the guide shoes or guide rollers touch the guide rails appropriately throughout the entire length of the elevator movement.

In document WO 9323323, a deviation measurement device for measuring the deviation of a lift guide rail in a lift well is disclosed. It comprises a laser for emitting a reference beam relative to a lift rail. A carriage mounted on the rail and is freely suspended from a lift car by a support arm. The carriage has a carriage mount with guide rollers for allowing the carriage to move on the rail and a sensor support section for mounting a sensor for detecting the laser beam. A stepping motor is provided for moving the sensor so that the sensor tracks the laser beam and provides an indication of the deviation of the guide rail.

In document EP 2733105 A1, an elevator alignment tool is disclosed. It comprises a longitudinal frame having rollers being configured to run along the surface of a guide rail of an elevator construction. The frame comprises a bias means for biasing the frame against the guide rail and a connecting part configured to be connected to an elevator car or an installation time platform. The tool further comprises a laser mounted to the frame.

Drawbacks of the current solutions are that the alignment contains multiple manual steps which is time-consuming, or dedicated devices which are cumbersome to operate. The work needs to be performed accurately and trained personnel is needed, which can create a bottleneck in the construction of an elevator.

SUMMARY

An object of the present disclosure is to alleviate at least one of the problems in the prior art. It is especially the object of the present disclosure to provide a method and an arrangement for aligning guide rails.

The method and arrangement are in particular, but not only, intended for the installation and maintenance work of elevators, especially for passenger or cargo elevators of buildings.

The guide rail alignment method according to the present disclosure is characterized by what is presented below.

The guide rail alignment arrangement according to the present disclosure is characterized by what is presented below.

The method and the arrangement according to the present disclosure may offer at least one of the following advantages over prior art.

The use of a combination of a light source on the vertically moveable base and a target member removably attached to the guide rail increases alignment accuracy thus improving final installation quality. The light source and the positioning of the target member allow the direct measurement of guide rail position, and no offset to a light source needs to be taken into account, since sling components or other equipment present in the elevator shaft are avoided by the positioning. This speeds up and simplifies the alignment process.

Determination of the correct guide rail direction is simplified as guide rail center may be used to acquire the alignment target. In prior art, offset dimensions which need to be interpreted and re-calculated are a source of potential mistakes. In the method and arrangement according to the present disclosure, they can be avoided making the verification of alignment more straightforward and thus more reliable.

In the method, the light source is always at the level of the previously aligned guide rail section. Such distances are especially suited to the accuracy of the light source. This further increases the improvement in quality.

As the positioning light source is on the vertically moveable base, it can be protected from the environment by the base structures and/or by a cover that can be used when the light source is not in use. This avoids damage to the positioning light source by dust or welding slag that may be present in the elevator shaft during installation work. This again, may increase the lifetime of the light source.

BRIEF DESCRIPTION OF DRAWINGS

The accompanying drawings, which are included to provide a further understanding of the disclosure and constitute a part of this specification, illustrate embodiments and together with the description help to explain the principles of the invention but the invention is not limited to the specific embodiments illustrated in the drawings. In the drawings.

DETAILED DESCRIPTION

Figure 1:
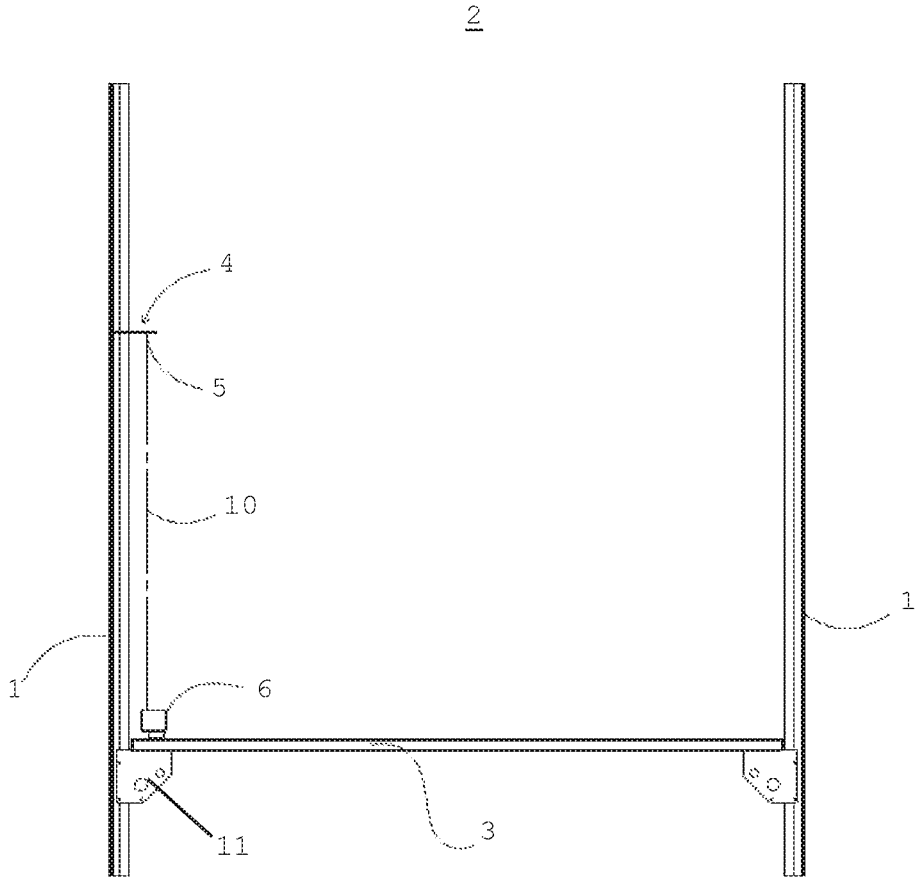
FIG. 1 presents an embodiment of an elevator guide rail alignment arrangement according to the present disclosure.

In one aspect, a guide rail alignment method is disclosed. The method comprises attaching and aligning a first pair of elevator car guide rail sections in an elevator shaft and mounting a vertically moveable base between the guide rail sections. The first pair of guide rail sections may be the first pair of guide rail sections to be installed in the elevator shaft. However, in the context of the current disclosure, the first pair of guide rail sections means the first pair that is used in the current method. It is thus possible that one or more pairs of guide rail sections have been installed previously.

The vertically moveable base means a surface that is moveable along the installed guide rails and can accommodate the positioning light source. The vertically moveable base thus follows the path of the elevator car in the final construction. By vertically moveable is herein meant that the movement of the base has a vertical component. The movement can thus deviate from vertical, i.e. the movement can be slanted. In some embodiments, the movement is only vertical. That is, the vertically moveable base, and the final elevator car, move up and down.

In one embodiment of the method, the vertically moveable base is an elevator car sling, an elevator car or a working platform. Depending on the installation arrangement, for example a temporary working platform or the sling of the final elevator car can be used. It is also possible to use the elevator car itself. A temporary platform or the elevator car sling may be covered or open. When an elevator car sling is used, it can be equipped with temporary structures to accommodate the installation personnel. The vertically moveable base may be driven along the already-installed guide rails as is known in the art.

The method according to the present disclosure is characterized in that after the first pair of elevator car guide rail sections has been aligned, a target member comprising a target point is removably attached to a guide rail section, and a positioning light source able to produce a beam of collimated light is removably attached to the vertically moveable base, so that a beam of collimated light emitted in a vertical direction by the positioning light source meets the target point of the target member. The beam can be a point beam or, for example, comprise a cross-line. The light may be emitted downwards from the light source. The light may alternatively be emitted upwards from the light source.

The light beam can meet the target point of the target member with variable accuracy. It depends on the specifics of the installation how accurate the targeting needs to be. Therefore, the light beam meeting the target point should be understood to include a predetermined tolerance, which the skilled person is able to determine for each installation.

The removable attachment of the target member and the positioning light source mean that they are not integral parts of the guide rail or vertically moveable base, respectively. In other words, they can be removed intact. However, advantageously their attachment, although temporary, is robust so that they may be relied on in keeping their position as long as necessary. For example, the positioning light source may remain in one position even throughout the installation of the complete guide rail. The target member is typically removed after the alignment for the guide rail section in question is ready, but it may be possible to attach the target member already before the guide rail section is moved into its location in the elevator shaft. A target member may thus be pre-attached, in which case it may remain in place for a longer period of time.

It is possible to attach the positioning light source in different structures of the vertically moveable base. It would, for example, be possible to mount it on the top of the elevator car or elevator car sling. It may alternatively be possible to attach the positioning light source to one or both side beams of the elevator car sling. In one embodiment of the method, the positioning light source is positioned on the bottom of the vertically moveable base.

After the positioning light source has been positioned with the aid of the target member, a second pair of guide rail sections is attached and a target member comprising a target point is removably attached to a guide rail section of the second pair of guide rail sections so that the target point is at an identical position in the horizontal direction relative to the guide rail as the target point for the first pair of guide rail sections. Then, the guide rail section of the second pair of guide rail sections is aligned so that the light beam produced by the positioning light source meets the target point of the target member attached to the guide rail section of the second pair of guide rail sections.

By a guide rail section is meant a section of a guide rail that is attached from its one end to an adjacent guide rail section or from its both ends to two adjacent guide rail sections. A guide rail is formed by attaching guide rail sections end-to-end.

By a target member is herein meant a device that is attachable to a guide rail section for analyzing the straightness of the guide rail section. The target member comprises a target point, to which the collimated light according to the present disclosure can be aimed. The target point may be formed as cross-hairs, a pinhole or a light-sensitive area on the target member, for example. A target member may comprise more than one target point at different positions of the target member. This might allow the use of the same target member in installations with variable specifications, which, in turn, might be cost-effective.

The target member has a rigid enough form that allows it to remain firmly positioned so that accurate alignment can be achieved. The target member may comprise attachment means for attaching it to the guide rail section. The attachment means preferably allows reproducible attachment, meaning that the location of the target point relative to the guide rail can be reproduced accurately at different positions along the guide rail length. A tolerance of 0-1.0 mm, for example 0.5 mm, can be considered acceptable in most applications. For example, the attachment means may comprise a slot matching the shape of the guide rail cross-section. The target member may thus be fork-shaped so that the slot is formed between the two The attachment means may further comprise tightening means such as a screw or a clip to ascertain the attachment of the target member.

The target member may be manufactured of, for example, different metals, such as steel, aluminium or their alloys. Alternatively, various plastic or composite materials, or combinations of metals, plastics or composite materials may be used.

The target member is removably attached to the guide rail. This means that the target member can be attached and detached from the guide rail, possibly several times. It may offer advantages to use the same target member repeatedly during the same installation, or in several installation sites. However, in some applications, disposable target members might be usable.

In one embodiment of the method, at least one target member comprises more than one target point, and/or wherein more than one target member is removably attached to at least one guide rail section. The method may be implemented so that more than one target point is used. This may allow the determination of the guide rail straightness in different directions. Further, if a target member comprises more than one target point, the same target members may be used in installations with variable dimensions. This may broaden the range of situations in which a target member of given design may be used making the device more versatile.

It is possible to position the target member either above or below the vertically moveable base in the elevator shaft. In one embodiment of the method, the target member is attached above the vertically moveable base. Having the target member above the base might in many embodiments be the more practical alternative, as the vertically moveable base would only be driven along already aligned guide rails. This configuration might also avoid having to run the vertically moveable base up and down for attaching and detaching the target members.

In one embodiment of the method, the target member is attached to the upper end of a second guide rail section, or within the upper 50% of a second guide rail section length, or within the upper 20% of a second guide rail section length. Attaching the target member as far away as possible from the positioning light source may improve the accuracy of the method. However, the longer the distance from the light source to the target member, the more the light beam diverges. This means that the point or cross created by the light beam is the larger the further the light source and the target member are from each other. For example, a distance of at least 1 m, such as 1.2 m may be sufficient. However, longer distances, such as 1.5 m, 3 m or 5 m may be used. For large-scale installations longer distances, such as 10 m may be acceptable. The selection of a suitable position may depend on the installation in question. For example, the length of the guide rail section and the light source properties may influence the solution. In some situations, it may be possible to attach the target member to the end of the guide rail section.

In the current disclosure, a positioning light source able to produce a beam of collimated light is used. Such light source may produce a light beam with a minor divergence. Typically, the light source according to the present disclosure is self-leveling, so that it may produce a beam of light in the predetermined direction even if the base on which it rests is not always in the same angle. In some cases it is possible to adjust the angle in which the beam of light is produced to allow the use of the current method also in installations in which the guide rails do not run exactly in the vertical direction, such as slanted elevators or elevators in buildings of unusual shapes.

By a predetermined direction is herein meant a direction in which the guide rails are designed to extend. In one embodiment, the beam of collimated light is emitted in a vertical direction. This reflects the most common situation, in which the elevator car moves up and down. However, in cases of slanted elevators, for example, the direction of the guide rails may deviate from vertical. In such a case, the predetermined direction is selected accordingly. In most situations, the deviation from vertical is less than 60°, for example 45° or 15°.

In one embodiment of the method, the positioning light source is a laser source. Self-leveling lasers, sometimes equipped with magnetic attachment means, are known in the art and the selection of a suitable device is within the competence of the skilled person. Both cross-line and point lasers are known in the art. Alternatively other sources of collimated light can be used. For example LED might be suitable. Light of different wavelengths or ranges of wavelengths may be used in the method according to the present disclosure. Red wavelengths are suitable in many applications.

The positioning light source is removably attached to the vertically moveable base. Thus, the positioning light source may be removed after the installation. In one embodiment of the method, the positioning light source is attached to the vertically moveable base magnetically. This may be especially advantageous in case the base is of magnetic material, for example material that comprises iron, such as steel. The positioning light source may be attached to the vertically moveable base alternatively by double-sided tape, various adhesives or by a vacuum suction cup. Also, it is possible to screw the positioning light source to the vertically moveable base. In such a case, the vertically moveable base may comprise pre-drilled holes for the light source. Also a combination of said attachment solutions may be used.

It may be advantageous to remove the positioning light source between cycles of aligning the newly installed guide rail sections. This may have the advantage that the positioning light source is not in the way of installation work, since in many situations the same vertically moveable base may be used attaching guide rail sections. Removing the positioning light source when it is not in use may also protect the light source from damage.

To this end, the location of the positioning light source may be marked on the vertically moveable base so that the light source may be returned to the same position accurately. In one embodiment of the method, the positions of the positioning light sources are marked on the vertically moveable base.

Since typically two guide rails are installed in parallel, it may be advantageous to use one light source to align both guide rail sections one after the other, and to move the positioning light source correspondingly between the aligning locations for each of them. This may be economical, for example, in situations where one person is aligning both guide rails. In some embodiments, however, two light sources may be used, especially if alignment of both guide rails can be performed simultaneously.

In one embodiment of the method, two positioning light sources are attached to the vertically moveable base, so that the light beam produced by each positioning light source meets the target point of the target member in one guide rail section allowing the simultaneous alignment of both guide rail sections in a pair of guide rail sections.

In the first phase of the method, after the target member has been attached to the guide rail section, the positioning light source is removably attached to the vertically moveable base, so that light emitted by the positioning light source meets the target point of the target member. Thus, the target member is first attached to the guide rail section of the first pair of guide rail sections and the light source is then positioned so that the beam of light meets the target point with a predetermined accuracy. The incidence of light on the target point may be visually inspected, and the target point may comprise visual aids to improve the accuracy of the inspection.

In the second phase, the position of the light source is used to guide and/or to verify the alignment of the second and following guide rail section. This is done by attaching a second pair of guide rail sections and removably attaching a target member comprising a target point to a guide rail section of the second pair of guide rail sections so that the target point is at an identical position in the horizontal direction relative to the guide rail as the target point for the first pair of guide rail sections. Then, the guide rail section of the second pair of guide rail sections is aligned so that the light beam produced by the positioning light source meets the target point of the target member attached to the guide rail section of the second pair of guide rail sections.

The identical positioning of the target point in the horizontal direction relative to the guide rail follows simply when an identical target member is attached identically in different positions along the guide rail length. Minor variation due to, for example, material properties is possible without affecting the end result.

It is possible to vary the order in which the method is performed. For example, it may be possible to already check—and possibly correct—the alignment of one guide rail section while the target member is still being attached to the other guide rail section of the pair of guide rail sections in question. Alternatively, both target members can be attached before the positioning of the light source or the checking of alignment is performed. In other words, the method can be performed independently for each guide rail section of the pair of guide rail sections.

It may be possible to continue installing a guide rail section belonging to the next pair of guide rail sections while the alignment of a guide rail section of the previous pair is still ongoing. Both guide rail sections of the second pair of guide rail sections may be aligned substantially simultaneously, or one after the other, before installing the following pair of guide rail sections. This allows the verification of the distance between guide rails (DBG) immediately after both guide rails have been aligned. The alignment itself may be performed as known in the art.

The suitable sequence of actions can be selected by the skilled person based on the installation site properties, such as guide rail length, ease of alignment, available personnel and the like.

As the completed guide rail comprises a number of pairs of guide rail sections, the second phase of the method, i.e. guiding and/or verification of the alignment of the next guide rail section may be repeated a corresponding number of times. It is thus possible to attach and align at least one further guider rail section in the same manner as the second guide rail section.

In one embodiment of the method, after the second pair of guide rail sections has been attached and aligned, at least one further pair of guide rail sections is attached and aligned in the same manner as the second pair of guide rail sections. It may be advantageous that the positioning light source remains in the same position during attaching and aligning of at least one further pair of guide rail sections. In other words, the positioning light source is positioned based on the first guide rail section and the same position is held for the second and further guide rail section. This reduces the time that is needed for re-positioning the positioning light source. The advantages may be proportional to the number of guide rail sections that are attached and aligned while the positioning light source remains in one position. In some cases, it may be advantageous to adjust the position during the installation of a given guide rail. However, it is possible that the positioning light source remains in one position during the installation of the complete guide rail.

Depending on the length of the guide rails, attaching a further pair of guide rail sections, removably attaching a target member to a guide rail section of the further pair of guide rail sections and aligning the guide rail section of the further pair of guide rail sections so that the light beam produced by the positioning light source meets the target point are repeated, for example 10-100 times, for example 50 times. In high-rise buildings, even hundreds of guide rail sections, such as 150 or 200 guide rail sections, may be assembled into one guide rail.

It is also possible to check or to adjust the position of the positioning light source on the vertically moveable base during the procedure. In such a case, the target member may be attached to any of the previously aligned guide rail sections and the position of the positioning light source can be changed so that the beam of collimated light emitted by the positioning light source meets the target point of the target member.

Since the method may be repeated a number of times during the installation of an elevator, it may provide advantages to automate the procedure at least partly. For example, the target member can be designed so that the incidence of light on the target point is automatically detected and signaled. An optic sensor may be used. Further, it may be possible to design the target point so that the direction to which the guide rail section needs to be moved or bent in order to achieve alignment is detected and indicated by the target point or target member. For example, a phototransistor connected to a computer may be used. Further, the alignment may be performed by automatic means, such as a robot, which is controlled by a computer.

In one embodiment of the method, the positioning light source is positioned on the bottom of the vertically moveable base, the vertically moveable base comprises a top structure and the top structure comprises at least one opening, for example two openings, to allow the passage of the light beam through each opening.

The top structure according to the present disclosure may be a beam extending above the vertically moveable base, it can be a ceiling or a protective cover, for example. Any structure belonging to the vertically moveable base or attachable to it and preventing the passage of the light to the target member can be considered a top structure.

The need to have an opening in the top structure of the vertically moveable base depends on the positioning of the light source. If the light source is positioned under a top beam of the elevator car sling, an opening is needed. This may be a typical location for the light source, since the elevator car sling, or frame, is often constructed between the guide rails. Further, a position along a line between the blades of the guide rails may be advantageous also for the target point of the target member. This geometry would necessitate the positioning of the light source under the top beam.

In one embodiment of the method, the movement of the vertically moveable base is limited in horizontal directions to 0.5-1.0 mm. For example, the vertically moveable base may comprise a slide guide, such as a guide or a roller guide, limiting the horizontal movement of the base. The guide rails may have a T-profile in which the blade of each of the guide rails faces towards the other guide rail. In such a configuration, the horizontal movement of the vertically moveable base may be limited by slide guides surrounding the blade of each guide rail.

In one embodiment of the method, the method further comprises the verification of the distance between guide rails after alignment by an independent method. The distance between guide rails (DBG) should remain as constant as possible. The method according to the present disclosure may improve the evenness of DBG. However, the DBG may be verified with an independent method in one or more locations along the length of aligned guide rails.

In another aspect, an elevator guide rail alignment arrangement is disclosed. The arrangement comprises

- a positioning light source able to produce a beam of collimated light in a predetermined direction and removably attachable to a vertically moveable base;
- a target member being removably attachable to a guide rail section, and comprising a target point for measuring the alignment accuracy of a guide rail section;
- a vertically moveable base, such as a working platform, an elevator car sling or an elevator car, configured to accommodate a positioning light source.

The target member is attached to the guide rail. Typically an arrangement according to the present disclosure comprises more than one target member. Often one or two of the target members are simultaneously attached to the guide rails. There may be additional target members either attached to the guide rails or stored for use in the arrangement.

The positioning light source is placed on the vertically moveable base so that it may emit a beam of collimated light in a predetermined direction. In an embodiment, the predetermined direction is a vertical direction. The light source is moveably attachable to the base so that it can be positioned to direct the light beam for analyzing the alignment of a guide rail section with the aid of the target member that comprises a target point.

In one embodiment of the arrangement, the vertically moveable base comprises a slide guide limiting the movement of the vertically moveable base in horizontal directions. In installations where the guide rails have a T-profile comprising a blade, the slide guide may surround the blade from three horizontal directions. In one embodiment of the arrangement, the slide guide is configurable to limit the horizontal movement of the vertically moveable base to 0.5-1.0 mm. The smaller the margin of movement is, the more accurately the alignment may be performed. However, if the slide guide surrounds the guide rail very tightly, the up- and downward movement of the vertically moveable base may be restricted to an impractical degree. The skilled person is able to take these factors into account and to select a suitable horizontal movement range for the vertically moveable base.

In one embodiment of the arrangement, the vertically moveable base comprises a top structure, and the top structure comprises at least one opening, for example two openings, to allow the passage of a light beam through each opening. The size and shape of the opening may vary. The opening(s) may be coverable so that even if the light source is on continuously, the light does not shine through the top structure where installation of the next guide rail sections or other elevator components may be ongoing.

In one embodiment of the arrangement, the target member is attachable to the guide rail so that the center of the target point lies along a line extending horizontally between the centers of the guide rails. Such positioning may be advantageous since the positioning light source will be in the corresponding position, and therefore easily placeable on the vertically moveable base. In embodiments with a T-profiled guide rail, the center of the target point may thus lie along a line extending horizontally through the center of the blade of the guide rail.

In one embodiment of the arrangement, the center of the target point lies 0-200 mm, or 50-150 mm, or 100 mm towards the inside of the elevator shaft from the innermost position of the guide rail when the target member is attached to the guide rail section. By innermost is herein meant the position closest to the center of the elevator shaft. In embodiments with a T-profiled guide rail, the center of the target point lies 0-200 mm, or 50-150 mm, or 100 mm towards the inside of the elevator shaft from the tip of the blade. The suitable position for the target point may depend on the application. However, for example 100 mm will in many embodiments offer a suitable clearance from the sides of the vertically moveable base and other elevator components. This location may at the same time avoid having to position the corresponding positioning light source centrally to the vertically moveable base where it might disturb the installation work. However, it may sometimes be advantageous to position the target point at the tip of the blade or other innermost position of the guide rail. In such embodiments, the distance to the guide rail may be even 0 mm.

DESCRIPTION OF DRAWINGS

The following figures are to be understood as exemplary embodiments of the method and the arrangement according to the present disclosure. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described below may also be employed without departing from the scope of the invention, which is defined in the accompanying claims.

There are various controlling and safety devices for the elevator which may be present already when the current method and/or arrangement are implemented, but all of them have been omitted from the figures for clarity and any conventional methods can be used for their design. All parts of the arrangement are depicted only schematically and their sizes are not drawn proportionally. Further, all additional elevator components are omitted from the figures, although some of them might be present simultaneously with the current arrangement and/or during the implementation of the current method.

FIG. 1 presents an embodiment of an elevator guide rail alignment arrangement according to the present disclosure. In the figure, an elevator shaft 2 is depicted, but all components of the shaft are omitted for clarity. In the elevator shaft a pair of guide rail sections 1 has been installed. A vertically moveable base 3 has been mounted between the guide rail sections 1. The vertically moveable base uses slide guides 11 such as guide shoes or roller guides to mediate the contact between the guide rail sections 1 and the base 3.

A target member 4 has been attached above the vertically moveable base on the guide rail section 1. Only one target member 4 is visible in the figure, but in some embodiments one on each guide rail section 1 may be used. The target member 4 comprises a target point 5.

A positioning light source 6 has been removably attached on the vertically moveable base 6. Since the guide rail sections 1 have been previously aligned, the target point 5 on the target member 4 may be used to position the light source 6. In FIG. 1, the light beam 10 is visible (dashed line). The light source 6 is thus positioned so that the emitted light beam 10 meets the target point 5. The position of the light source 6 may be now marked on the vertically moveable base 6 to allow the re-positioning the light source 6 correctly, if it is removed from its current position during the installation of the guide rail.

The second guide rail section 1 of the first pair of guide rail sections may be used similarly to position a light source 6. This light source 6 may be the same or a different one as the one depicted in FIG. 1.

Figure 2:
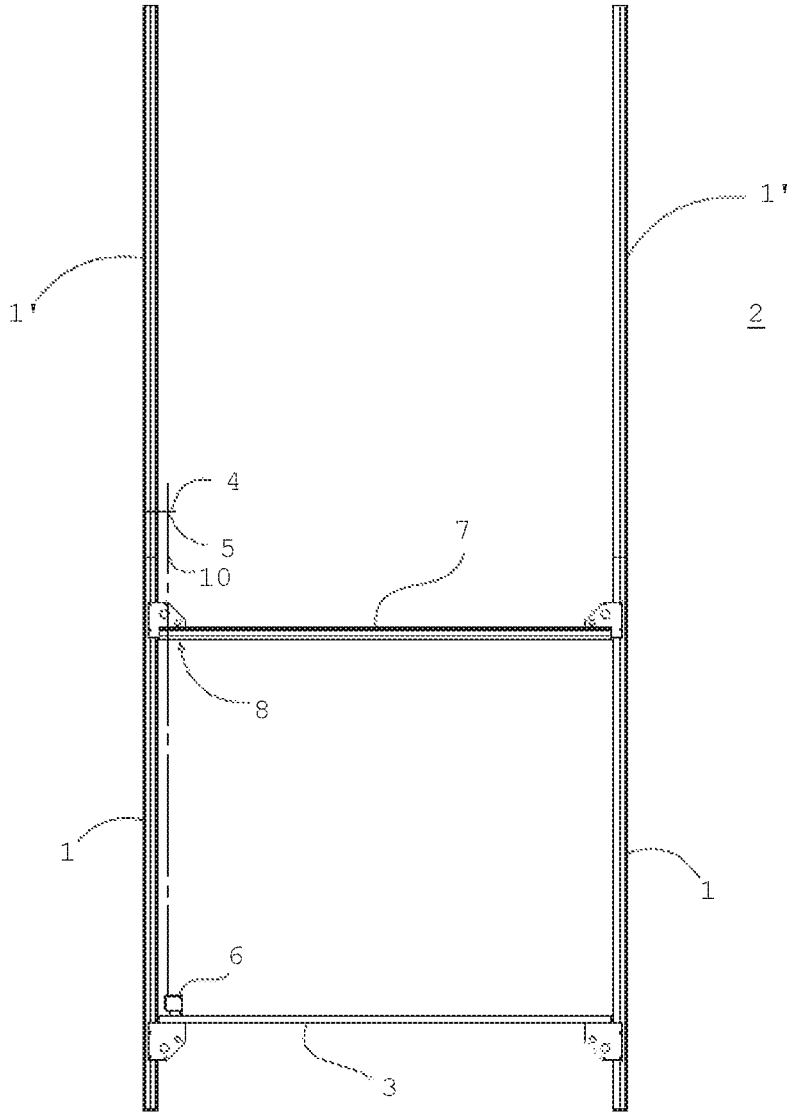
FIG. 2 presents an embodiment of an elevator guide rail alignment arrangement according to the present disclosure.

FIG. 2 presents an embodiment of an elevator guide rail alignment arrangement according to the present disclosure. The embodiment is similar to that of FIG. 1, but the base 3 comprises a top structure 7. The top structure 7 is typically attached to the bottom part of the base 3 by vertically extending beams or other support structures. However, such structures are omitted from the figure for clarity. The top structure may comprise slide guides 11 (not marked in FIG. 2). As in FIG. 1, the arrangement of FIG. 2 is in an elevator shaft 2 and comprises a positioning light source 6 emitting a beam of collimated light 10. In this embodiment, the predetermined direction of the light beam 10 is vertical.

However, in FIG. 2, the second pair of guide rail sections 1' has been attached on top of the first pair of guide rail sections 1. The target member 4 and a target point 5 are attached on a guide rail section 1' of the second pair of guide rail sections. Thus, FIG. 2 depicts the second phase of the method, in which the position of the positioning light source 6 is used to adjust and verify the alignment of the second pair of guide rail sections 1'.

Since the vertically moveable base 3 comprises a top structure 7, and the positioning light source 6 and the target member 4 are positioned on its opposite sides, the light beam 10 (dashed line) has to pass through the top structure 7 to allow the determination of the straightness of the guide rail sections 1'. Therefore, the top structure 7 comprises an opening 8 allowing the light beam 10 to reach the target member 4. In this perspective, the opening 8 is not visible, but it may be of variable size and shape, depending on the dimensioning of the elevator components.

In FIG. 2, the second pair of guide rail sections 1' has been aligned, since the light beam 10 passes through the target point 5. If the guide rail section 1' was tilted or twisted, the light beam 10 would be offset in respect to the target point 5.

Figure 3:
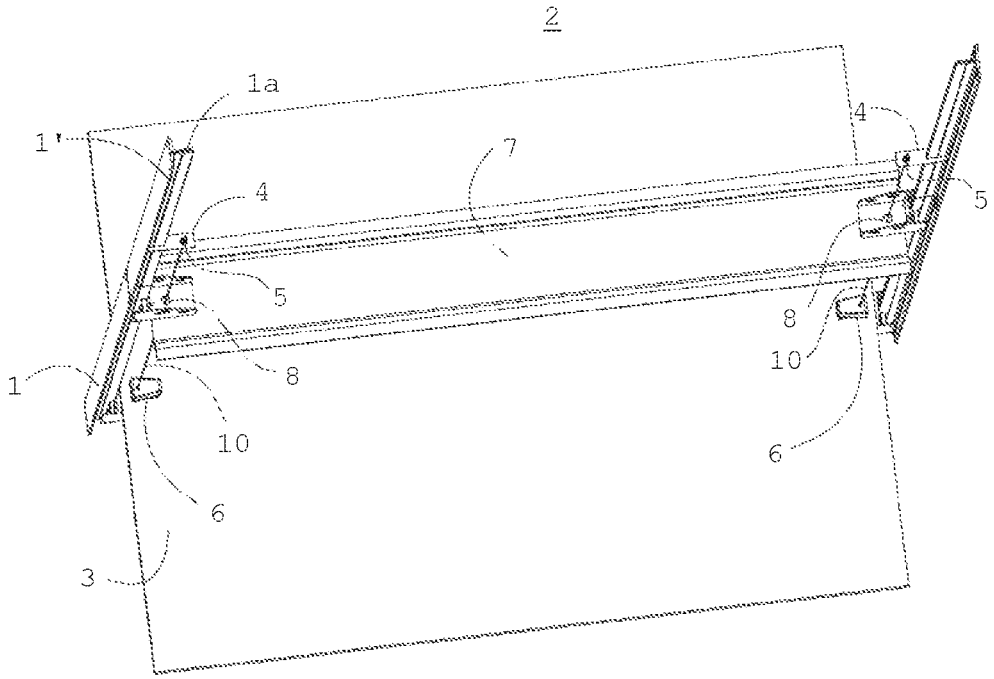
FIG. 3 presents an embodiment of an elevator guide rail alignment arrangement according to the present disclosure in which the second pair of guide rail sections is being aligned.

FIG. 3 presents an embodiment of an elevator guide rail alignment arrangement according to the present disclosure in which the second pair of guide rail sections 1 is being aligned.

In FIG. 3, the vertically moveable base 3 comprises a top structure 7. In this embodiment, the top structure 7 is a flat beam. However, the top structure 7 may be broader than depicted in FIG. 3. In this perspective, the opening 8 is visible, being a hole in this embodiment. Due to the dimensions of the embodiment, the opening 8 extends through the supporting structures of the base 3 in addition to the top structure 7. In some other embodiments, the opening may extend only through the top structure 7.

The guide rail sections 1, 1' have a T-profile comprising a blade portion 1*a*. The target member 4 is fork-shaped and attached to the blade 1*a* by the forked structure that surrounds the blade 1*a*. Thus, the forked portion functions as an attachment means of the target member 4. Although in FIG. 3, the forked structure of the target member 4 completely surrounds the blade 1*a*, it is possible that it would surround it only partially.

The positioning light source 6 is on the bottom of the vertically moveable base 3. In this perspective, the advantageous positioning of the light source 6 and the target member 4 can be seen. They are both positioned on the line between the blades 1*a* of the guide rail sections 1, 1'. Thus, the light beam 10 passes through the top structure 7.

In the embodiment of FIG. 3, both guide rails may be aligned simultaneously, as the embodiment comprises two positioning light sources 6, two target members and they are all assembled simultaneously for each guide rail. As can be seen in FIG. 3, both guide rail sections 1' of the second pair of guide rails are aligned, as the light beam 10 meets the target point 5.

Figure 4:
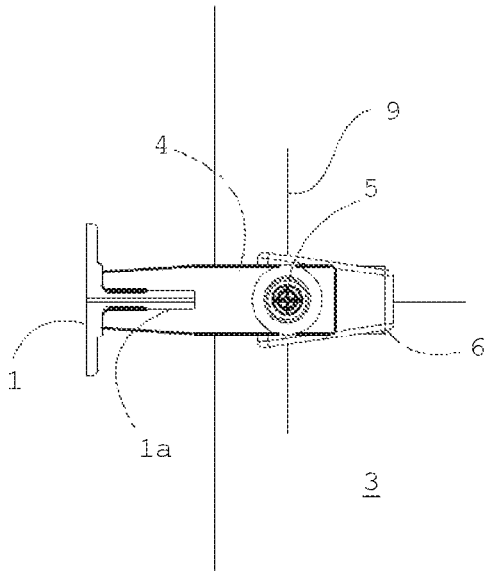
FIG. 4 visualizes the use of a positioning light source and a target member.

FIG. 4 visualizes the use of a positioning light source 6 and a target member 4. In the figure, the positioning light source 6 and a target member 4 are viewed from the direction of the target member 4. The vertically moveable base 3 is shown in the background and the position of the positioning light source 6 has been marked on the base 3 by guiding lines 9. Alternatively, the contour of the light source 6 could be used. The light source 6 may comprise markings that help in its positioning (not shown).

The shape of the target member 4 is shown in FIG. 4. In this embodiment, the forked attachment means is configured to extend to the base of the blade 1*a*. This may be advantageous in acquiring sufficient support for the target member. Although not visible in the figure, the target member 4 may comprise extensions extending downwards along the guide rail to further support the target member 4.

The target point 5 is visible I FIG. 4, and it comprises markings that allow the determination of the closeness of the center of the target point 5 (i.e. "the bull's eye"). For example, the target member 4 may comprise a number of concentric circles around the target point 5 to assist in the alignment. In the figure, the beam of light is nog visible, but in the aligned, position of the guide rails, it would pass through the center of the target point 5 or would meet the target member 4 within a predetermined distance from the center of the target point 5.

The invention claimed is:

1. A guide rail alignment method, comprising:

attaching and aligning a first pair of elevator car guide rail sections in an elevator shaft;

mounting a vertically moveable base between the first pair of elevator guide rail sections, the vertically moveable base being one of an elevator car sling, an elevator car or a working platform configured to support a installation personnel within the elevator shaft;

removably attaching a first target member to a respective one of the first pair of elevator guide rail sections after the first pair of elevator car guide rail sections has been aligned, the first target member including a first target point;

removably attaching a positioning light source to the vertically moveable base such that the positioning light source is supported by the one of the elevator car sling, the elevator car or the working platform with a beam of collimated light emitted by the positioning light source meeting the first target point;

attaching a second pair of guide rail sections in the elevator shaft;

removably attaching a second target member having a second target point to a respective one of the second pair of guide rail sections such that the second target point is at a same position in a horizontal direction as the first target point; and aligning the second pair of guide rail sections so that the beam produced by the positioning light source meets the second target point.

2. The method according to claim 1, wherein the removably attaching the positioning light source includes removably attaching the positioning light source to the vertically moveable base such that the beam of collimated light is emitted in a vertical direction.

3. The method according to claim 1, wherein the first target member is attached to the respective one of the first pair of elevator guide rail sections above the vertically moveable base.

4. The method according to claim 1, wherein the positioning light source includes a pair of positioning light sources each attached to the vertically moveable base, the removably attaching the first target member includes removably attaching a pair of first target members to respective ones of the first pair of elevator guide rail sections, the pair of first target member each including first target points, and the removably attaching the positioning light source includes removably attaching the pair of positioning light sources to the vertically moveable base such that beams emitted by the pair of positioning light sources meet respective ones of the first target points allowing simultaneous alignment of both of the first pair of elevator guide rail sections.

5. The method according to claim 1, wherein the positioning light source is positioned on a bottom of the vertically moveable base.

6. The method according to claim 1, wherein the vertically moveable base comprises a top structure, the top structure having an opening therein to allow passage of the beam through the top structure.

7. The method according to claim 1, wherein the second target member is attached to an upper end of the respective one of the second pair of elevator guide rail sections.

8. The method according to claim 1, wherein movement of the vertically moveable base is limited in the horizontal direction to 0.5-1.0 mm.

9. The method according to claim 1, wherein after the second pair of guide rail sections has been attached and aligned, at least one further pair of guide rail sections is attached and aligned in the same manner as the second pair of guide rail sections, and wherein the positioning light source remains in the same position during attaching and aligning of at least one further pair of guide rail sections.

10. The method according to claim 1, wherein the positioning light source is supported by the elevator car sling vertically movable within the elevator shaft.

11. The method according to claim 1, wherein the positioning light source is supported by the elevator car vertically movable within the elevator shaft.

12. The method according to claim 1, wherein the positioning light source is supported by the working platform vertically movable within the elevator shaft and configured to support the installation personnel within the elevator shaft.

* * * * *